United States Patent [19]

Jung

[11] Patent Number: 4,603,993

[45] Date of Patent: Aug. 5, 1986

[54] INFORMATION REEL SYSTEM

[76] Inventor: Hae-Ryong Jung, 3230 Brookmede Rd., Ellicott City, Md. 21043

[21] Appl. No.: 676,801

[22] Filed: Dec. 5, 1984

[51] Int. Cl.[4] ..... B43K 29/00; G09F 3/00

[52] U.S. Cl. ..... 401/195; 401/52; 40/334; 40/335; 40/518; 434/178

[58] Field of Search ..... 401/52, 195, 196; 40/334, 335, 518, 905; 434/26, 157, 173, 178; 400/616.1, 616.2

[56] References Cited

U.S. PATENT DOCUMENTS

| | | | |
|---|---|---|---|
| 1,760,785 | 9/1929 | Sledge et al. | 40/518 |
| 1,993,514 | 3/1935 | Kahn | 40/335 |
| 2,029,750 | 2/1936 | Young | 40/518 |
| 2,837,839 | 6/1958 | Fernbach | 434/157 |
| 3,991,498 | 11/1976 | Beach | 434/157 |
| 4,143,473 | 3/1979 | Mitsuya | 434/157 |
| 4,292,750 | 10/1981 | Zuffellato | 40/334 |
| 4,445,864 | 5/1984 | Price | 434/173 |

FOREIGN PATENT DOCUMENTS

| | | | |
|---|---|---|---|
| 426664 | 3/1926 | Fed. Rep. of Germany | 40/335 |
| 725963 | 9/1940 | Fed. Rep. of Germany | 434/178 |

*Primary Examiner*—Richard J. Apley
*Assistant Examiner*—Alfedo Acoff
*Attorney, Agent, or Firm*—Morton J. Rosenberg

[57] ABSTRACT

An information reel system (10) is provided for displaying information on sheet material (32) contained therein. The information reel system (10) includes a substantially closed and transparent housing (24) within which there is mounted an upper and lower reel mechanism (42 and 44). The upper and lower reel mechanisms (42 and 44) have mounted thereon the sheet material (32) containing indicia information (12 and 12'). Rotational activation of upper and lower reel mechanisms (42 and 44) allows the viewer to see corresponding indicia information (12 and 12') in different sections of transparent housing (24). Upper and lower reel mechanisms (42 and 44) are coupled each to the other by means of coupling mechanisms (54 and 56) mounted within transparent housing (24) on opposing longitudinal ends thereof. The coupling mechanisms (54 and 56) provide a rotational displacement of the upper and lower reel mechanisms (42 and 44) responsive to a predetermined rotational force and further maintain the upper and lower reel mechanisms (42 and 44) in a longitudinally restrained condition. Writing implements (14 and 16) are coupled to upper and lower reel mechanisms (42 and 44) and extend external to transparent housing (24) to allow the user to write information. The user may view all sections of transparent housing (24) or may be provided with a cover member (102) which includes a transparent section (106) and an opaque section (108) to block from view a portion of transparent housing (24) and allow the user to see indicia information (12) and/or indicia information (12') at one time by rotating the cover member (102) over transparent housing (124).

19 Claims, 6 Drawing Figures

INFORMATION REEL SYSTEM

BACKGROUND OF THE INVENTION

1. Field of the Invention

This invention pertains to information reel systems wherein information may be viewed by the user. This invention relates to an information reel system which includes a transparent housing within which upper and lower reel mechanisms are rotationally mounted. Further, this invention directs itself to an information reel system wherein corresponding and correlating indicia information may be viewed by the user in various portions of the overall system. More particularly, this invention pertains to an information reel system which is mounted in coupled relation to writing implements which may be used by the user in combination with the information reel system. Still further, this invention directs itself to an information reel system wherein reel mechanisms may be rotated in only a singular direction. Still further, this invention directs itself to an information reel system wherein a cover member may be inserted over the overall housing to provide a transparent portion and an opaque portion wherein only certain amounts of information may be read by the user at one time. Still further, this invention relates to an information reel system wherein indicia information may be contained on opposing sides of sheet material to maximize the information viewable by the user. Additionally, this invention pertains to an information reel system wherein rotational reel mechanisms mounted within a transparent housing are coupled each to the other in a predetermined manner to provide longitudinal restraint of the individual reel mechanisms and allow fixed rotational displacement between the upper and lower reel mechanisms.

2. Prior Art

Information reel systems are known in the art. The best prior art known to the Applicant includes U.S. Pat. Nos. 3,991,498; 4,445,864; 4,143,473; and, 2,837,839.

U.S. Pat. No. 3,991,498 is directed to a double reel type of learning aid wherein a pair of axles having sheet material contained thereon may be rotated. However, such axles are not mounted each to the other to provide cooperation therebetween, as is necessary to the subject invention. Additionally, such axle rotation members do not provide for sheet material to have corresponding indicia mounted on opposing surfaces thereof to maximize information contained thereon. Still further, such systems do not provide for combination writing implement information reel systems.

In other prior art systems such as that shown in U.S. Pat. No. 4,445,864, singular windows are provided between opposing reel members and such does not allow correlating indicia information to be viewed in different portions of the information reel system. Additionally, such prior art systems do not provide for the coupling of the rotating axles to allow for registration and constrainment of information in distinct portions of the window openings.

SUMMARY OF THE INVENTION

An information reel system for displaying information contained thereon. The information reel system includes a longitudinally extended substantially transparent housing. Sheet material having opposing surfaces with informational indicia formed thereon is positionally located within the transparent housing. An upper and lower reel mechanism is provided with each extending in the longitudinal direction and being rotatively coupled to the housing. The sheet material is secured on opposing ends of both the upper and lower reel mechanisms respectively. The reel system further includes a coupling mechanism for coupling the upper and lower reel mechanisms each to the other in order to provide a predetermined rotational displacement of each of the upper and lower reel mechanisms responsive to a predetermined rotational force applied to at least one of the upper and lower reel mechanisms as well as to longitudinally restrain displacement of the upper and lower reel mechanisms.

DESCRIPTION OF THE PREFERRED EMBODIMENTS

Figure 1:
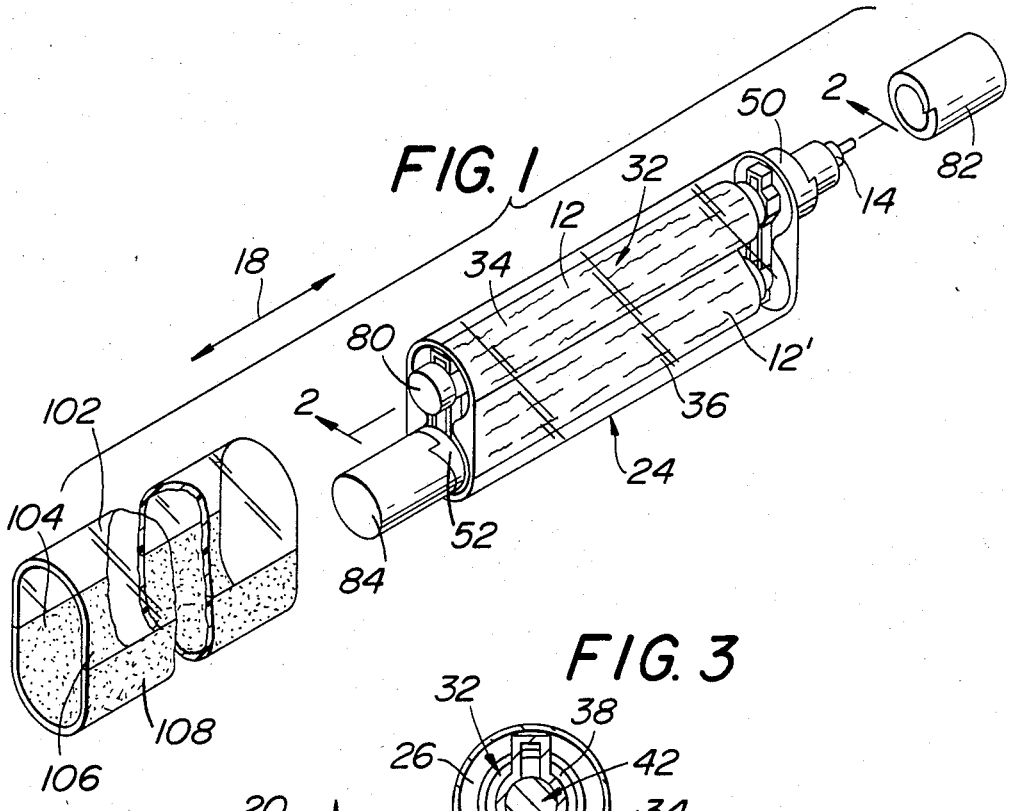
FIG. 1 is a perspective view of the information reel system showing a cover member in partial cut-away.
Figure 3:
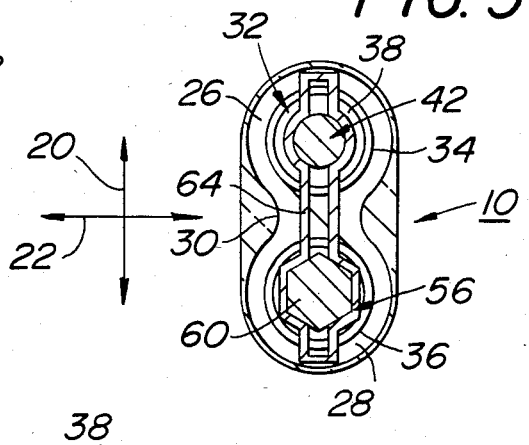
FIG. 3 is a sectional view of the information reel system taken along the Section Line 3—3 of FIG. 2.
Figures 2, 6:
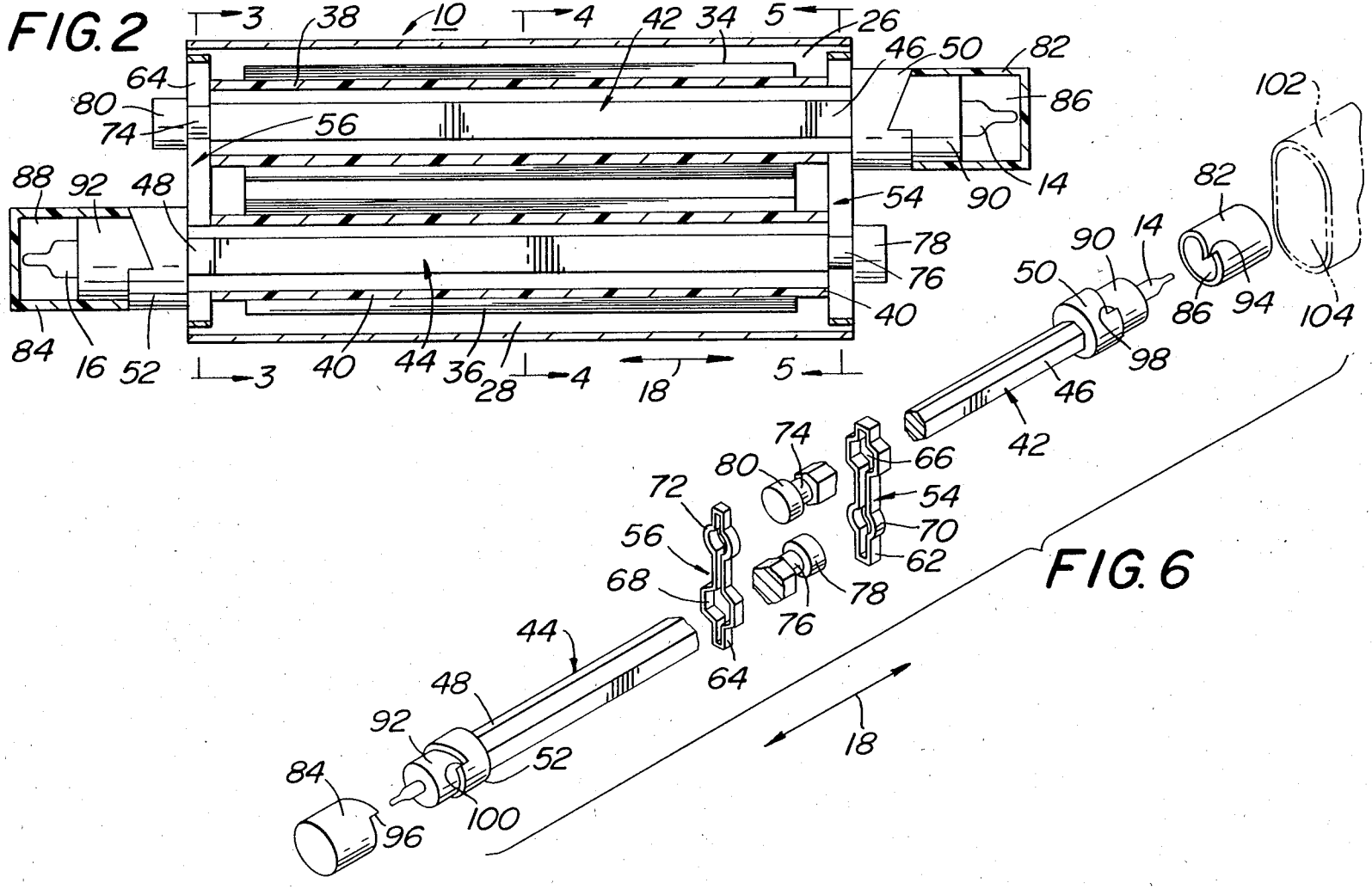
FIG. 2 is a sectional view of the information reel system taken along the Section Line 2—2 of FIG. 1.

Referring now to FIGS. 1–5, there is shown information reel system 10 for displaying indicia information 12 and 12' contained thereon. As will be seen in following paragraphs, information reel system 10 allows the user to read indicia information 12 at an upper portion thereof while being able to read correlating indicia information 12' in a lower area as is shown in FIG. 1. Although indicia information 12 and 12' may be any information, by way of example, indicia information 12 may be wording in one language with indicia information 12' being a translation of such wording into a secondary language. As will be seen, one or the other of indicia information 12 and 12' may be blocked out from visual acceptance by the user. Additionally, information reel system 10 is also combined with writing implements 14 and 16 as is shown in FIGS. 1 and 2. In this manner, information reel system 10 allows the user to provide himself or herself with a total information system wherein various indicia information 12 and 12' may be read, digested, and notes jotted down pertaining to such information.

Figure 4:
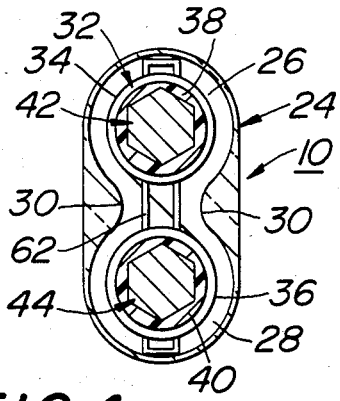
FIG. 4 is a sectional view of the information reel system taken along the Section Line 4—4 of FIG. 2.
Figure 5:
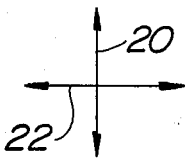
FIG. 5 is a sectional view of the information reel system taken along the Section Line 5—5 of FIG. 2; and, FIG. 6 is a perspective view of the upper and lower reel mechanisms of the information reel system taken in exploded and partially cut-away view.
Figure 5:
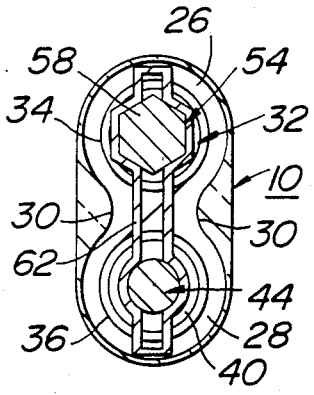

Referring now to FIGS. 1, 4 and 2, information reel system 10 includes reel system housing 24 which extends in longitudinal direction 18. In general, reel system housing 24 is generally transparent in order that indicia information 12 and 12' may be read easily from external to system 10. Reel system housing 24 may be generally formed of a plastic material composition and may be injection molded, extrusion molded, or formed in some like molding technique not important to the inventive concept as herein defined. Reel system housing 24 is generally formed in an oblong type cross-section, as is clearly seen in FIG. 4, when taken with respect to vertical direction 20. Reel system housing 24 includes housing upper chamber 26 and housing lower chamber 28, as is seen in FIG. 4. Upper housing chamber 26 and lower housing chamber 28 are in open communication, each with respect to the other. As can be clearly seen in FIGS. 3–5, housing 24 includes throat portion 30 having a dimension in transverse direction 22 which is less than the diameter of the internal upper and lower chambers 26 and 28. Throat portion 30 of housing 24 extends in longitudinal direction 18 substantially throughout the longitudinal extension of housing 24. In addition to maintaining components within housing 24, the varying thickness of the walls of housing 24 may be utilized as a lens system for magnifying particular portions of indicia information 12 and 12' for ease of reading by the user. As can be clearly understood, the varying thickness of the walls of transparent housing 24 may provide the user with a magnifying lens type component while further serving the purpose of maintaining various components in alignment, each with respect to the other, as will be seen in following paragraphs.

Information reel system 10 further includes sheet material 32 including opposing sheet material surfaces 34 and 36 as is seen in FIGS. 1, 3, 4 and 5. In the manner of wrapping and rotation of sheet material 32 within housing 24, it can be clearly seen that certain indicia information 12 may be contained on sheet material surface 34 while correlating indicia information 12' is contained on opposing sheet material surface 36 with the respective indicia informations 12 and 12' being read at an upper portion of housing 24 and a lower portion of housing 24. By using opposing sheet material surfaces 34 and 36 of sheet material 32, the user is able to maximize the amount of indicia information 12 and 12' contained on sheet material 32 for use in information reel system 10.

Referring now to FIG. 6, there is shown upper reel mechanism 42 extending in longitudinal direction 18 and rotatably coupled to substantially transparent reel housing 24. Additionally, lower reel mechanism 44 extends in longitudinal direction 18 and is similarly rotatably coupled to reel system housing 24 to allow manual rotation of both upper and lower reel mechanisms 42 and 44 by a user. Sheet material 32 is secured on opposing ends thereof to upper and lower reel mechanisms 42 and 44 respectively.

Upper and lower reel mechanism 42 and 44 include respective upper and lower axle members 46 and 48. Upper and lower axle members 46 and 48 are mounted within sheet attaching axle members 38 and 40. Axle members 46 and 48 may be hexagonal in cross-sectional contour and matingly engage an inner surface of sheet attaching axles 38 and 40. In this manner, rotative displacement of axle members 46 and 48 results in a responsive rotation of axles 38 and 40, as well as a displacement of sheet material 32.

Upper and lower reel mechanism 42 and 44 as is seen in FIGS. 1, 2 and 6 further includes respective upper and lower rotational activation members 50 and 52 which extend external reel housing 24 on opposing longitudinal ends of housing 24 as is clearly seen in FIGS. 1 and 2. Upper and lower rotational activation members 50 and 52 are secured to respective axle members 46 and 48 either by adhesive bonding, bolting, or some like technique, not important to the inventive concept as herein described with the exception that rotation of either upper rotational activation member 50 or lower rotational activation member 52 will cause a responsive rotation of upper and lower reel axle members 46 and 48.

It is to be understood that writing implements 14 and 16 extending from upper rotational activation members 50 and 52 may be either coupled thereto, or in the alternative, where writing implements 14 and 16 are pens, upper and lower reel axle members 46 and 48 may include chambers wherein writing fluid may be contained. Where upper and lower reel axle members 46 and 48 are portions of writing implements 14 and 16, upper and lower rotational activation members 50 and 52 may be mounted in secured attachment to the external surfaces of axle members 46 and 48 through bonding, or some like technique. In this particular case, axle members 46 and 48 are then formed in cooperation and possibly in one-piece formation with writing implements 14 and 16. Alternatively, writing implements 14 and 16 may be separate and distinct from axle members 48 and 46, with both implements 14, 16 and axle members 46, 48 being secured in fixed attachment respectively to upper and lower rotational activation members 50 and 52.

Referring to FIGS. 2 and 6, information reel system 10 further includes coupling mechanisms 54 and 56 for coupling upper and lower reel mechanism 42 and 44 each to the other for: (1) providing a predetermined rotational displacement of each of upper and lower reel mechanisms 42 and 44 responsive to a predetermined rotational force applied to at least one of upper and lower reel mechanisms 42 and 44 as well as (2) longitudinally restraining displacement of upper and lower reel mechanisms 42 and 44 in longitudinal direction 18. Coupling mechanisms 54 and 56 are mounted on polygonally contoured upper and lower axle members 46 and 48 on opposing longitudinal ends of transparent housing 24, as is seen in FIGS. 2 and 6. Additionally, coupling mechanism 54 and 56 defines spring members 62 and 64 which are adapted to matingly engage respective reel members 46 and 48. Spring members 62 and 64 are formed of spring type steel, rigid plastic material, or some like material which is yieldingly displaceable in transverse direction 22 responsive to a rotation of upper and lower axle members 46 and 48.

Each of spring members 62 and 64 includes a polygonally contoured insert passage 66 and 68 for engagement with respective axle members 46 and 48 for sliding insert thereon. As can be understood, the walls of spring member 62 and 64 in the area of insert passages 66 and 68 are yieldingly displaceable responsive to a rotation of upper and lower reel mechanisms 42 and 44. The polygonal contour of passages 66 and 68 should be similarly or coincidentally sided with axle members 46 and 48 and should generally be of a dimension to allow mating slidingly engaged contact thereon. In this manner, rotation of upper and lower reel mechanisms 42 and 44 provide for responsive rotation of axle members 46 and 48. As axle members 46 and 48 are rotated in a clockwise or counter-clockwise direction, registration of similar sides between axle members 46 and 48 and insert passages 66 and 68 are attained to provide a rotation to a specific registration and thus, allow fixed positional locations of sheet material 32 within transparent housing 24. In this manner, sheet material 32 is maintained in a substantially fixed positional location within transparent housing 24 until the user further rotates upper or lower reel mechanisms 42 or 44. Thus, the cooperation between insert passages 66 and 68 with respective axle members 46 and 48 provides for a rotational constrainment of sheet material 32 within housing 24 until the user further rotates reel mechanisms 42 and 44. In one form of the invention, it is seen that axle members 46 and 48 with cooperating spring member insert passages 66 and 68 are hexagonally contoured.

Each of spring members 62 and 64 includes a substantially circularly formed portion 70 and 72 as is seen in FIG. 6 defining circular insert through passages. The circular portions 70 and 72 engage recesses 74 and 76 of upper and lower axle members 46 and 48. As can be seen in FIG. 6, circular portions 70 and 72 as well as polygonal insert passages 66 and 68 of respective spring members 62 and 64 are inverted when taken with respect to vertical direction 20 and are mounted on opposing longitudinal ends of transparent housing 24. Thus, circular portion 70 of spring member 62 is insertable within insert recess 76 of axle member 48 and is mounted within shoulder 78 having a diameter greater than insert recess 76. Additionally, spring member 64 includes circular portion 72 which is mounted within insert recess 74 having a diameter less than shoulder 80 formed on upper reel axle member 46. In this manner, spring member 62 is longitudinally restrained with respect to lower axle member 48 within recess 76. Additionally, spring member 64 is longitudinally restrained with respect to upper axle member 46 within recess 74.

Each of spring members 62 and 64 may be formed in closed contour and in one-piece formation however, each of spring members 62 and 64 must be yieldingly displaceable responsive to a rotational displacement of respective axle members 46 and 48.

Rotational activation members 50 and 52 also include means for rotating upper and lower reel mechanisms 42 and 44 in only a singular direction. Thus, reel mechanisms 42 and 44 are adapted to be rotated in either the clockwise or counter-clockwise direction but not in either direction. In order to provide rotation in a singular rotational direction, upper rotational activation cap member 82 and lower rotational activation cap member 84 are provided as is clearly seen in FIGS. 1, 2 and 6. Upper and lower rotational activation cap members 82 and 84 include internal passages 86 and 88, respectively within which writing implements 14 and 16 may be inserted as is seen in FIG. 2. Cap member insert passages 86 and 88 have a dimension which allows longitudinal sliding insert on wall sections 90 and 92 of rotational activation members 50 and 52, respectively. In this manner, cap members 82 and 84 may be longitudinally inserted over respective rotational activation members 50 and 52. Each of cap members 82 and 84 include respective shoulders 94 and 96 which interface with shoulders 98 and 100 of respective rotational activation members 50 and 52. In this manner, it is clearly seen that cap member 82 as well as cap member 84 may only be rotated in a singular direction. Thus, if the user rotated either of cap members 82 or 84 in an opposing rotational direction, with respect to the interface between shoulders 94, 98 or 96, 100, cap members 82 and 84 would merely slide on wall sections 90 and 92 and there would be no responsive rotation of axle members 46 or 48. This would maintain sheet material 32 in fixed position within transparent housing 24.

Referring now to FIG. 1, information reel system 10 may further include housing cover member 102 having a longitudinally extending through passage 104. Through passage 104 is contoured to be slidingly inserted over the external surface of transparent housing 24 in longitudinal direction 18. Additionally, housing cover 102 may be formed of a plastic-like material cellophane film or some like composition having upper half portion 106 which is substantially transparent and lower half portion 108 which may be opaque. In this manner, the user may visually be able to see indicia information 12 within housing upper chamber 26 while indicia information 12' in lower chamber 28 is blocked from view. When the user wishes to correlate indicia information 12 with indicia information 12', housing cover member 102 may be slidingly and rotatingly removed in reversible direction 22 in order to allow the user to visually observe indicia 12 and/or 12'. In this manner, the user may observe indicia 12 or 12' separately or in combination in order to efficiently allow memorization, comparison, and/or observation of indicia 12 and 12'. If indicia 12 and 12' are not related to each other, housing cover 102 may be removed from housing 24.

It is to be understood that information reel system 10 as herein presented is shown and described utilizing writing implements 14 and 16 mounted to rotational activation members 50 and 52. In other embodiments, writing implements 14 and 16 may be substituted by other members such as cigarette lighters or other implements which are functionally useable. Where writing implements 14 and 16 are substituted by cigarette lighters, axle members 42 and 44 may have reservoir chambers to contain lighter fluid, or some such fuel.

Although this invention has been used in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An information reel system for displaying information contained therein, comprising:

(a) a longitudinally extended substantially transparent housing;

(b) sheet material having opposing surfaces with informational indicia formed thereon;

(c) upper reel means extending in said longitudinal direction and rotatably coupled to said housing;

(d) lower reel means extending in said longitudinal direction and rotatably coupled to said housing, each of said upper and lower reel means including a respective upper and lower sheet attaching axle member, each of said axle members being secured to one end of said sheet material, said axle members being rotatively displaceable; and, (e) means for coupling said upper and lower reel means each to the other for (1) providing a predetermined rotational displacement of each of said upper and lower reel means responsive to a predetermined rotational force applied to at least one of said upper and lower reel means, and, (2) longitudinally restraining displacement of each of said upper and lower reel means, said means for coupling including a pair of polygonally contoured reel axle members matingly insertable within said respective sheet attaching axle members and a pair of spring members adapted to matingly engage a respective reel axle member and being laterally deformable responsive to said predetermined rotational force to provide said predetermined rotational displacement of said upper and lower reel means.

2. The information reel system as recited in claim 1 where said longitudinally extended substantially transparent housing includes an upper and lower chamber in open communication each with respect to the other.

3. The information reel system as recited in claim 2 where said upper and lower chamber are adapted in contour to receive said upper and lower reel means respectively.

4. The information reel system as recited in claim 3 where said upper and lower chambers include a cross-sectional diameter greater than said upper and lower reel means cross-sectional diameter.

5. The information reel system as recited in claim 4 where said upper and lower chamber define a throat portion joining said upper and lower chambers and having a transverse dimension less than said upper and lower chamber diameters.

6. The information reel system as recited in claim 1 where said upper and lower reel means includes:

a respective upper and lower rotational actuation member extending external said housing on opposing longitudinal ends thereof.

7. The information reel system as recited in claim 6 where said means for coupling said upper and lower reel means includes said upper and lower rotational activation members being secured to respective reel axle members.

8. The information reel system as recited in claim 7 where each of said spring members includes a polygonally contoured insert passage for engaging said respective reel axle members, said insert passage being yieldingly displaceable responsive to a rotation of said upper and lower reel means.

9. The information reel system as recited in claim 8 where each of said spring members includes a substantially circularly contoured insert passage for engaging a recess formed in one of said reel axle members.

10. The information reel system a recited in claim 9 where said reel axle member and said insert passage are hexagonally contoured.

11. The information reel system as recited in claim 10 where each of said spring members is formed in closed contour and in one-piece formation being yieldingly displaceable responsive to a rotational displacement of a respective reel axle member.

12. The information reel system as recited in claim 6 where each of said rotational activation members includes a writing implement secured to one end thereof and extending external said housing.

13. The information reel system as recited in claim 12 where said writing implement is a pencil.

14. The information reel system as recited in claim 12 where said writing implement is a pen.

15. The information reel system as recited in claim 12 where said reel axle members include a fluid reservoir chamber in fluid communication with said writing implement.

16. The information reel system as recited in claim 6 where each of said rotational activation members include means for rotating said upper and lower reel means in only a singular direction.

17. The information reel system as recited in claim 16 where said means for rotating said upper and lower reel means in only a singular direction includes respective cap members slidingly insertable over a portion of said rotational activation members for engaging a shoulder portion of said rotational actuation members in rotative displacement in said singular direction.

18. The information reel system as recited in claim 1 including a housing cover member defining a film belt having a longitudinally extending through passage, said housing cover member being slideably insertable and rotatable over said housing.

19. The information reel system as recited in claim 18 where said housing cover member includes a first portion substantially transparent and a second portion being substantially opaque.

* * * * *